US006461207B1

(12) United States Patent
Nanami

(10) Patent No.: US 6,461,207 B1
(45) Date of Patent: Oct. 8, 2002

(54) LUBRICATION SYSTEM FOR SMALL WATERCRAFT

(75) Inventor: Masayoshi Nanami, Iwata (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/497,569

(22) Filed: Feb. 3, 2000

(30) Foreign Application Priority Data

Feb. 3, 1999 (JP) ..... 11-026577

(51) Int. Cl.[7] ..... B63H 21/10
(52) U.S. Cl. ..... 440/88
(58) Field of Search ..... 440/88

(56) References Cited

U.S. PATENT DOCUMENTS 5,195,481 A * 3/1993 Oyama et al. ..... 123/196 R
5,490,474 A 2/1996 Ikeda
5,558,549 A 9/1996 Nakase et al.
5,588,887 A 12/1996 Ikeda
5,619,950 A 4/1997 Ikeda
5,634,832 A 6/1997 Nakase et al.
5,687,686 A * 11/1997 Takahashi ..... 123/195 P
5,829,402 A * 11/1998 Takahashi et al. ..... 123/184.24
5,839,930 A 11/1998 Nanami et al.
5,885,121 A 3/1999 Nanami et al.
5,899,779 A 5/1999 Hattori
5,951,343 A 9/1999 Nanami et al.
5,957,072 A 9/1999 Hattori
5,980,340 A * 11/1999 Okamoto ..... 440/88
5,983,631 A * 11/1999 Mineo ..... 60/299
5,997,372 A * 12/1999 Idzikowski et al. ..... 440/88

* cited by examiner

*Primary Examiner*—S. Joseph Morano
*Assistant Examiner*—Andrew Wright
(74) *Attorney, Agent, or Firm*—Knobbe, Martens, Olson & Bear, LLP

(57) ABSTRACT

A small watercraft includes a lubrication system having at least one pump, a lubricant reservoir, and a lubricant filter. The lubricant pump is configured to circulate lubricant between the reservoir, the filter and the engine. The lubricant filter is arranged either on a forward side or a rearward side of the lubricant reservoir. Alternatively, the lubricant filter may be mounted on a side of the engine opposite the lubricant reservoir and on a forward side or rearward side of the exhaust manifold. Further, the lubricant pump and the lubricant reservoir may be mounted rearward from a rear end of the engine body. Each of the arrangements provide an engine having a compactly arranged lubrication system which minimizes the affect on the overall width of the engine caused by the lubrication system.

27 Claims, 9 Drawing Sheets

LUBRICATION SYSTEM FOR SMALL WATERCRAFT

PRIORITY INFORMATION

The present application is based on and claims priority to Japanese Patent Application No. 11-26577, the entire contents of which is hereby expressly incorporated by reference.

BACKGROUND OF THE INVENTION

1. Field of the Invention

The present invention generally relates to a lubrication system of an internal combustion engine. More particularly, the present invention relates to a lubrication system of a small watercraft engine that powers a water propulsion device.

2. Description of Related Art

Personal watercraft have become very popular in recent years. An enthusiasm for competition has grown with this popularity, and as a result personal watercraft have become increasingly fast. Many personal watercraft today are capable of speeds well in excess of 60 mph. To attain such speeds, personal watercraft are typically driven by high power output motors.

Two-cycle engines commonly power personal watercrafts, as these engines have the advantage of being fairly powerful and relatively light and compact. One particular disadvantage of a two-cycle engine though, is emissions content. Two-cycle engines exhaust large quantities of carbon monoxide and various hydrocarbons. However, when steps are taken to reduce the emissions content of a two-cycle engine, other generally undesirable consequences result, such as an increase in the weight of the engine, cost of manufacture, and reduction of its power output.

Thus, four-cycle engines have now been proposed as the power plant for personal watercraft. These engines have the advantage of less hydrocarbon emissions than a two-cycle engine while maintaining a relatively high power output. It is therefore desirable to provide a small watercraft with a four-cycle engine in order to reduce exhaust emissions without significantly impacting the power output of the engine that powers the watercraft.

SUMMARY OF THE INVENTION

The present invention involves, in part, the recognition that several problems arise in connection with employing a four-cycle engine within a small watercraft. One such problem involves the fact that four-cycle engines are typically include wet-sump type lubrication system which require oil filled crankcases or reservoirs positioned at or near the bottom of the cylinder block of the engine. When this type of engine is mounted in a personal watercraft, the associated oil pump may not consistently draw oil from the crankcase as the oil sloshes from side-to-side with abrupt maneuvers of the watercraft.

If a large oil pan is provided at the bottom of the crankcase, the output of the engine must be raised further above the bottom surface of the hull of the watercraft, thus, affecting the angle at which the engine must be mounted within the hull so that the output shaft of the engine can reach the propulsion device, such as a jet pump, provided at the aft of the hull. Further, because the engine compartments of personal watercrafts are typically confined beneath the seat of the watercraft, upon which a user may sit in a straddle-type fashion, the overall width of the engine compartment directly affects the comfort level of a user sitting on the seat. Thus, the engine compartment is usually quite limited in space.

The present invention therefore provides an engine of a personal watercraft with a lubrication system which allows a four-cycle internal combustion engine to be mounted with its crankshaft close to a bottom surface of the hull and which minimizes the overall width of the engine compartment.

One aspect of the present invention provides a small watercraft comprising a hull defining an engine compartment and an internal combustion engine located within the engine compartment. A propulsion device is also carried by the hull and is driven by an output shaft of the engine to propel the watercraft. The engine includes a lubrication system having at least one lubricant pump, a lubricant reservoir and a lubricant filter, the pump being configured to circulate lubricant between the reservoir, the engine and the filter. The reservoir is arranged on one side of the engine and the filter is arranged in front of or behind the reservoir on the same side of the engine as the reservoir.

By arranging the lubricant filter forwardly or a rearwardly of the lubricant reservoir and on a same side of the engine as the reservoir, the present invention provides an engine having a lubrication system that is compact and allows the overall width of an engine compartment containing the engine to be minimized.

In accordance with a further aspect of the present invention, a watercraft is provided including a hull defining a engine compartment, an internal combustion engine contained within the engine compartment, and a lubrication system having a reservoir, a filter, and at least one pump, the pump being configured to circulate lubricant between the reservoir, the engine, and the filter. The engine also includes an exhaust manifold communicating with at least one of the combustion chambers defined within the engine. According to the invention, the oil filter is arranged on the same side of the engine as the exhaust manifold and on a rear side or a front side of the exhaust manifold. By arranging the oil filter as such, the effect on the overall width of the engine caused the oil filter is minimized, thus allowing the width of a seat mounted to the ending compartment to be constructed in a such a way so as to be comfortable for a rider to sit upon in a straddle-type fashion.

Further aspects, features, and advantages of the present invention will become apparent from the detailed description of the preferred embodiments which follow.

BRIEF DESCRIPTION OF THE DRAWINGS

The above-mentioned and other features of the invention will now be described with reference to the drawings of a preferred embodiment of the present invention. The illustrated embodiment of the lubrication system, which is employed in an engine of a watercraft, is intended to illustrate, but not to limit, the invention. The drawings contain the following figures.

DETAILED DESCRIPTION OF THE PREFERRED EMBODIMENTS OF THE INVENTION

Figure 1:
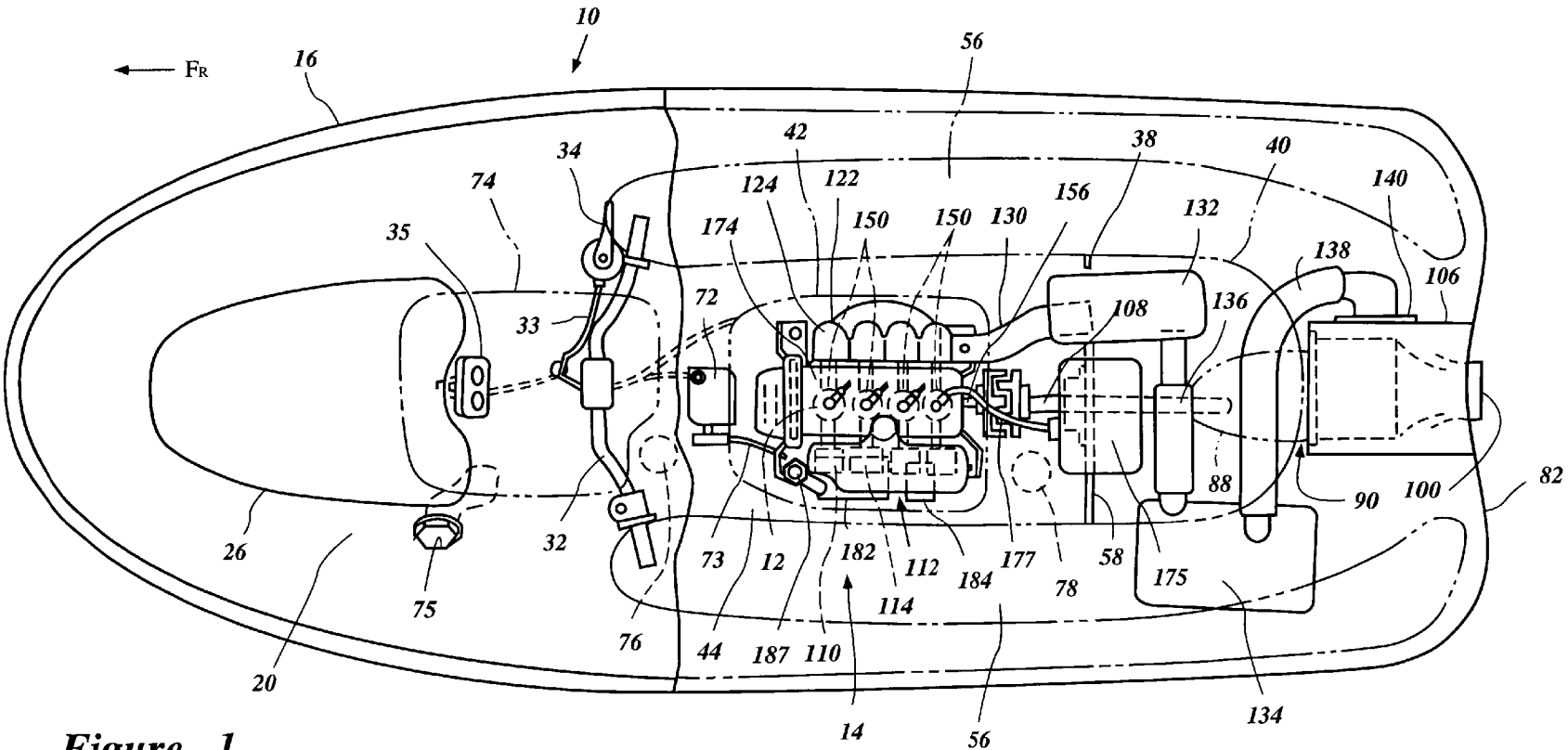
FIG. 1 is a sectional top plan view of a personal watercraft with a lubrication system configured in accordance with a preferred embodiment of the present invention, with various components of the watercraft illustrated in phantom.

With reference to FIG. 1, a small watercraft, indicated generally by the reference numeral 10, is illustrated. The watercraft 10 includes an arrangement of an engine 12 and a lubrication system, referred to generally by the reference numeral 14. The engine 12 and the lubrication system 14 are arranged within the hull 16 of the watercraft 10 in a manner which minimizes the overall width of the assembled engine 12 and lubrication system 14. As a result, the engine and lubrication system can be mounted within the engine compartment of a small watercraft which is formed beneath a seat of the watercraft, upon which a rider may sit in a straddle-type fashion.

Although the present lubrication system 12 is illustrated in connection with a personal watercraft, the illustrated lubrication system 12 can be used with other types of watercraft which have engine compartments that are limited in size such as, for example, but without limitation, small jet boats and the like. All of the embodiments disclosed are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

The following describes the illustrated watercraft in reference to a coordinate system in order to ease the description of the watercraft. A longitudinal axis extends from bow to stem and a lateral axis from port side to starboard side normal to the longitudinal axis. In addition, relative heights are expressed as elevations in reference to the undersurface of the watercraft. In FIG. 1, a label FR is used to note the direction in which the watercraft travels during normal forward operation.

Figure 2:
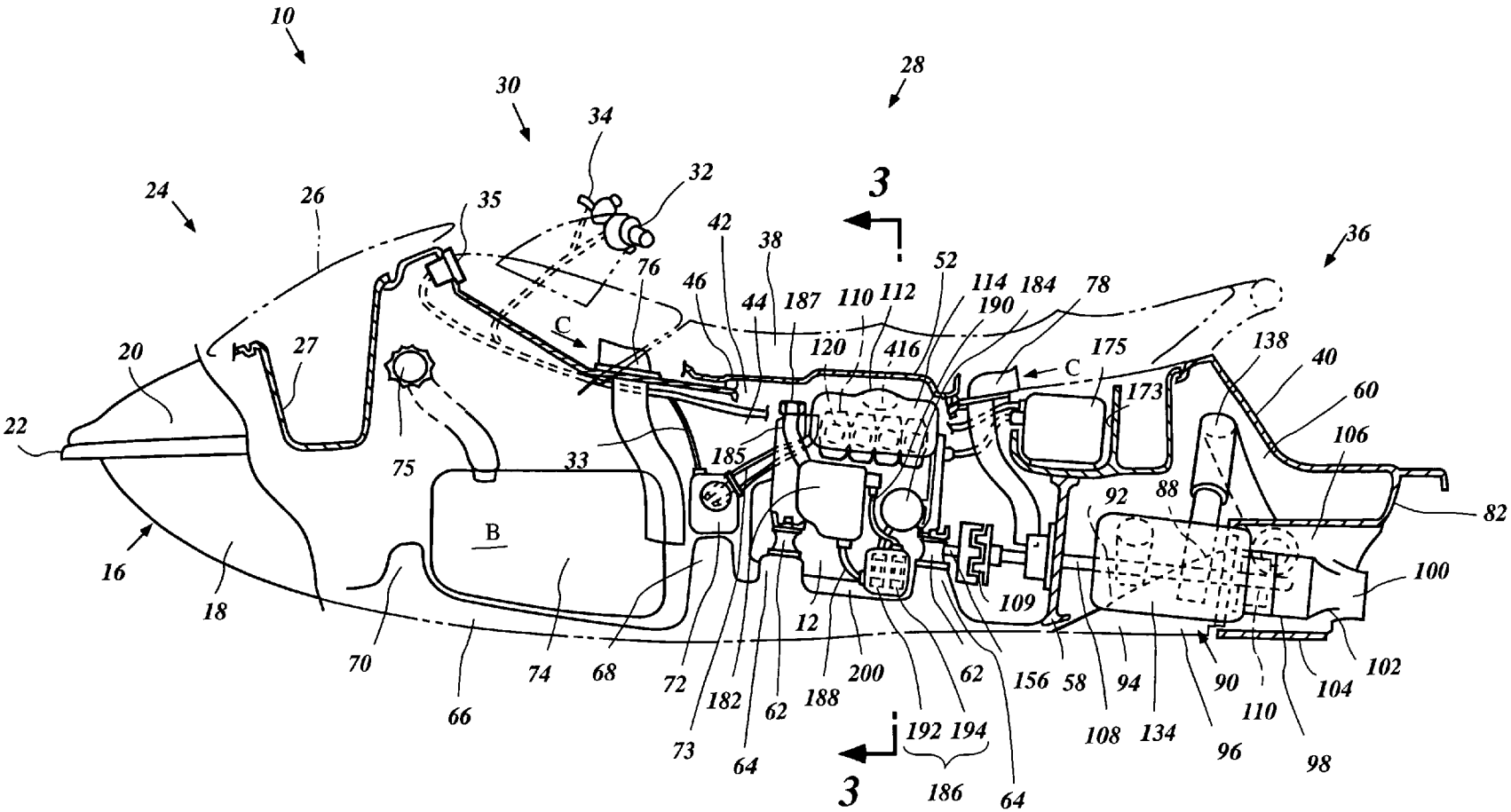
FIG. 2 is a partial sectional side elevational view of the personal watercraft of FIG. 1, with various components shown in phantom.

Before describing the lubrication system 14 within the watercraft 10, an exemplary personal watercraft 10 will first be described in general detail to assist the reader's understanding of the environment of use. The watercraft 10 has a hull, indicated generally by the reference numeral 16. The hull 16 can be made of any suitable material; however, a presently preferred construction utilizes molded fiberglass reinforced resin. The hull 16 generally has a lower hull section 18 and a upper deck section 20, as shown in FIG. 2. A bond flange or gunnel 22 may connect the lower hull section 18 to the upper deck section 20. Of course, any other suitable means may be used to interconnect the lower hull section 18 and the upper deck section 20. Alternatively, the lower hull section 18 and the upper deck section 20 may be integrally formed.

As viewed in the direction from the bow to the stern of the watercraft 10, the upper deck section 20 includes a bow portion 24, an access cover 26 and a rider's area 28. A storage bin 27 may be positioned beneath the access cover 26. Between the access cover 26 and the rider's area 28, a control mast 30 is provided which supports a handlebar assembly 32. The handlebar assembly 32 controls the steering of the watercraft 10 in a conventional manner. The handlebar assembly 32 also carries a variety of controls of the watercraft 10, such as, for example, a throttle control 34, a start switch (not shown) and a lanyard switch (not shown). Additionally, a gauge assembly 35 is preferably mounted to the upper deck section 20 forward of the control mast 30. The gauge assembly 35 includes a variety of gauges which include, for example, but without limitation, a fuel gauge, a speedometer, an oil pressure gauge, a tachometer, and a battery voltage gauge.

The rider's areas 28 lies behind the control mast 30 and includes a seat assembly 36. The seat assembly 36, at least in principal part, is formed by at least one seat cushion 38 supported by a raised pedestal 40. However, the seat assembly 36 may include a plurality of individual seat cushions.

The raised pedestal 40 forms a portion of the upper deck 20, and has an elongated shape that extends longitudinally along the center of the watercraft 10. The seat cushion 38 desirably is removably attached to a top surface of the raised pedestal 40 by one or more latching mechanisms (not shown) and covers the entire upper end of the pedestal 40 for rider and passenger comfort.

An engine access opening 42 is located in the upper surface of the pedestal 40. The access opening 42 opens into an engine compartment 44 formed within the hull 16. The seat cushion 38 normally covers and seals closed the access opening 42. When the seat cushion 38 is removed, the engine compartment 44 is accessible through the access opening 42.

As noted above, the seat assembly may comprise a plurality of individual seat cushions. Thus, at least one seat of the seat cushions preferably covers at least a portion of the access opening 42. If desired, a seal 46 may be provided.

Preferably, the seal 46 extends around the periphery of the access opening 42 and cooperates with the seat cushion 38 to form a seal and prevent water from entering the engine compartment 44.

Figure 3:
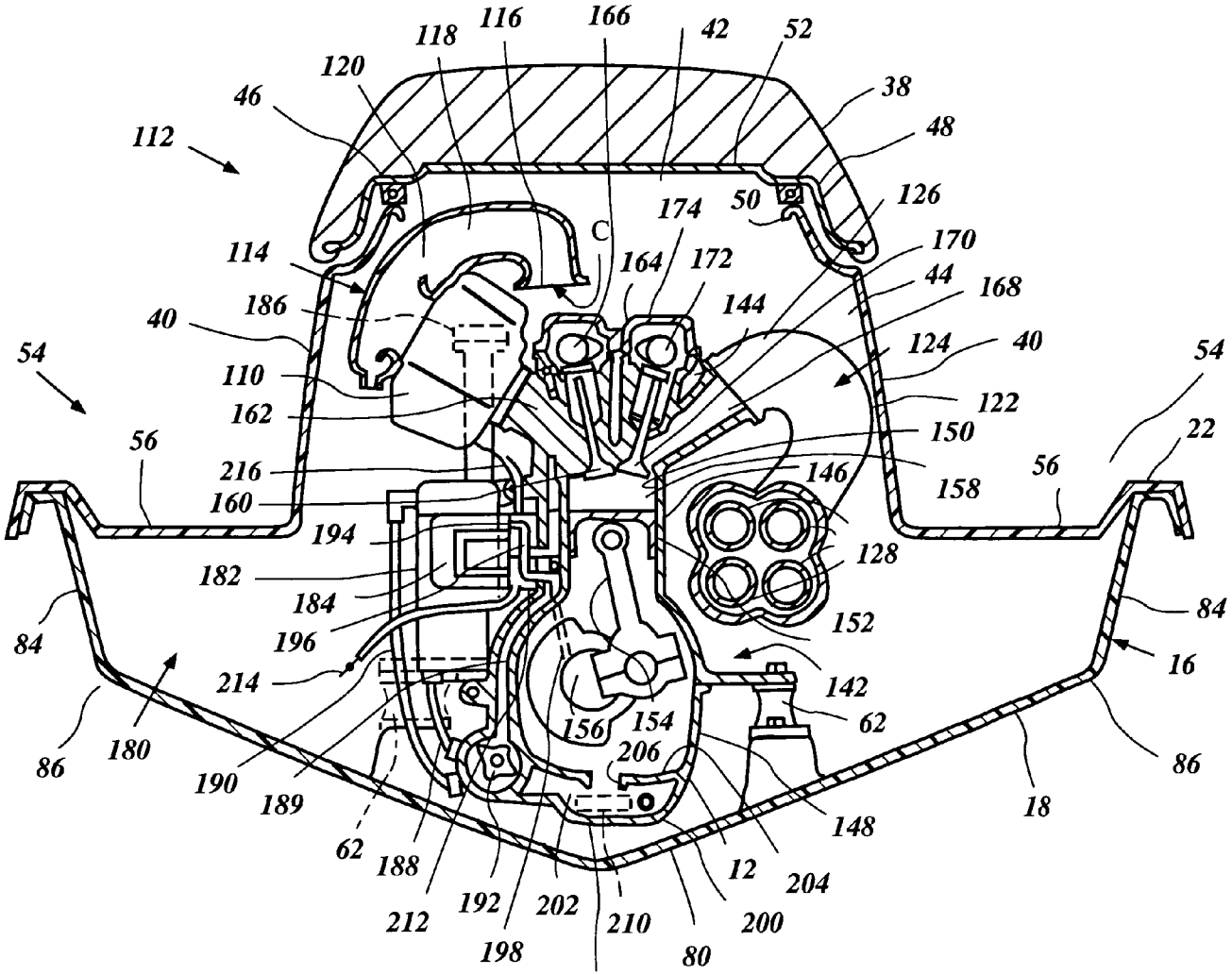
FIG. 3 is a cross-sectional view of the watercraft of FIG. 2 taken along line 3—3.

With reference to FIGS. 2 and 3, the seat cushion 38 preferably includes a frame member 48 which extends along a lower surface of the seat cushion 38. The frame member 48 preferably is formed of a rigid material, such as plastic, for example. As such, the frame member 48 provides a rigid structure to which a softer material forming the seat cushion 38 may be attached. Additionally, the frame member 48 cooperates with an inner peripheral edge 50 of the access opening 42 so as to substantially uniformly compress the seal 46 thus further preventing water from entering the engine compartment 44 through the access opening 42.

Also preferably, the frame member 48 includes a recessed area 52 which extends upwardly so as to enlarge the engine compartment 44. As such, the recessed area 52 allows components of the engine to extend up to and/or beyond the inner periphery 50 of the access opening 42, without contacting the frame member 48 or the seat cushion 38.

With reference to FIGS. 1–3, the upper deck portion 20 of the hull 16 advantageously includes a pair of generally planar areas 54 positioned on opposite sides of the seat pedestal 40, which define foot areas 56. The foot areas 56 extend generally along and parallel to the sides of the pedestal 40. In this position, the operator and any passengers sitting on the seat assembly 36 can place their feet on the foot areas 56 during normal operation of the watercraft 10. A nonslip (e.g., rubber) mat desirably covers the foot areas 56 to provide increased grip and traction for the operator and passengers.

With reference to FIG. 2, the hull 16 also includes one or more bulkheads 58 which may be used to reinforce the hull 16 internally and which also may serve to define, in part, the engine compartment 44 and a propulsion compartment 60 which is arranged generally rearward from the engine compartment 44. The engine 12 is mounted within the engine compartment 44 in any suitable manner. For instance, a set of resilient engine mounts 62 may be used to connect the engine 12 to a set of stringers 64. The engine 12 is desirably mounted in a central transverse position. The engine 12 may be of any known configuration. For example, the engine 12 may comprise any number of cylinders. The illustrated engine 12 is a four-stroke engine having four cylinders.

The stringers 64 may be molded into the lower portion 18 of the hull 16, or may be formed separately and bonded to the inner surface of the lower portion 18. Further, the stringers 64 may be formed on a liner 66 which is preformed with the stringers 64, as well as other contours and mounting surfaces. The liner 66 may be made out of any suitable material, such as molded fiberglass, reinforced resin. The liner 66 is preferably bonded to the inner surface of the lower hull portion 18.

The liner 66 may optionally include the throttle actuator mounting surface 68 and a fuel tank stop 70. A shown in FIG. 2, the throttle actuator mounting surface 68 is provided forward of the engine 12 and extends upwardly from the lower surface of the lower hull portion 18. A throttle position actuator 72 is mounted to the throttle actuator mounting surface 68 thus separating the throttle actuator 72 from the engine 12 and thereby attenuating vibration transferred to the throttle actuator 72. The throttle position actuator 72 is connected to the engine 12 via at least one actuator connector 73 for controlling the position of a throttle valve included in the engine 12. The throttle position actuator 72 receives throttle input signals from the operator via the throttle lever 34 and a throttle data line 33.

A fuel tank 74 is preferably arranged between the throttle actuator mounting surface 68 and the fuel tank stop 70. A fuel filler tube 75 preferably extends between the fuel tank 74 and the upper deck 20, thus allowing the fuel tank 74 to be refilled via the tube 75. Arranged as such, the liner 66 aids in preventing the fuel tank 74 from shifting during operation of the watercraft 10 and the associated fatigue of the filler tube 75.

With reference to FIGS. 1 and 2, a forward air intake 76 extends through the upper deck portion 20 adjacent the access opening 42. The forward air intake 76 allows atmospheric air C to enter the engine compartment 44. Similarly, a rear air duct 78 extends through an upper surface of the seat pedestal 40, preferably beneath the seat cushion 38, thus allowing atmospheric air C to enter the engine compartment 44. Air may pass through the air ducts 76, 78 in both directions, i.e., into and out of engine compartment 44. Except for the air ducts 76, 78, the engine compartment 44 is normally substantially sealed so as to enclose the engine 12 of the watercraft 10 from the body of water in which the watercraft 10 is operated.

The lower hull section 18 is designed such that the watercraft 10 planes or rides on a minimum surface area of the aft end of the lower hull section 18 in order to optimize the speed and handling of the watercraft 10 when up on plane. For this purpose, as best seen in FIG. 3, the lower hull section 18 has a generally V-shaped configuration formed by a pair of inclined sections that extend outwardly from a keel line 80 to outer chines (not shown) at a dead rise angle. The inclined sections extend longitudinally from the bow 24 toward the transom 82 of the lower hull section 18 and extend outwardly to sidewalls 84 of the lower hull section 18. The sidewalls 84 are generally flat and straight near the stern of the lower hull section 18 and smoothly blend towards a longitudinal center of the watercraft at the bow. The lines of intersection between the inclined sections and the corresponding sidewalls 84 form outer chines 86 which affect handling, as known in the art.

Toward the transom 82 of the watercraft 10, the inclined sections of the lower hull section 18 extend outwardly from a recessed channel or tunnel 88 that extends upward toward the upper deck section 20. The tunnel 88 has a generally parallelepiped shape and opens through the transom 82 of the watercraft 10.

In the illustrated embodiment, a jet pump unit 90 propels the watercraft 10, as shown in FIG. 2. The jet pump unit 90 is mounted within the tunnel 88 formed on the underside of the lower hull section 18 by a plurality of bolts (not shown). An intake duct 92, defined by the hull tunnel 88, extends between the jet pump unit 90 and an inlet opening 94 that opens into a gullet 96. The duct 92 leads to an impeller housing 98.

A steering nozzle 100 is supported at the downstream end of a discharge nozzle 102 of the impeller housing 98 by a pair of vertically extending pivot pins (not shown). In an exemplary embodiment, the steering nozzle 100 has an integral lever on one side that is coupled to the handlebar assembly 32 through, for example, a bowden-wire actuator, as known in the art. In this manner, the operator of the watercraft 10 can move the steering nozzle 100 to effect directional changes of the watercraft 100.

A ride plate 104 covers a portion of the tunnel 88 behind the inlet opening 94 to enclose the jet pump unit 90 within the tunnel 88. In this manner, the lower opening of the tunnel 88 is closed to provide a planing surface for the watercraft 10. A pump chamber 106 is thus defined within the tunnel section 88 covered by the ride plate 104.

An impeller shaft 108 supports an impeller 110 within the impeller housing 98. The aft end of the impeller shaft 108 is suitably supported and journaled within the compression chamber of the housing 98 in a known manner. The impeller shaft 108 extends in a forward direction through the bulkhead 58. A protective casing preferably surrounds a portion of the impeller shaft 108 that lies forward of the intake gullet 96. The forward end of the impeller shaft is connected to the engine 12 via a toothed coupling 109.

The engine 12 powers the impeller shaft 108. The engine 12 is positioned within the engine compartment 44 and its primarily beneath the seat assembly 36. As previously noted, the vibration absorbing engine mounts 62 secure the engine 12 to the lower hull section 18 and/or the liner 66. The engine is mounted in approximately the center line of the watercraft 10.

A fuel supply system delivers fuel B to the engine 12 in a manner known in the art. The fuel supply system includes the fuel tank 74 located in front of the engine 12. Although not illustrated, at least one pump desirably delivers fuel from the fuel tank 74 to the engine 12 through one or more fuel lines (not shown).

The fuel lines extend to charge formers which are configured to deliver charges of fuel to the engine. In the embodiment illustrated in FIG. 3, the fuel charge formers are in the form of carburetors 110. However, it is to be noted that the charge formers may be in the form of fuel injectors.

With reference to FIG. 3, the engine 12 typically draws air from the engine compartment 44 through an engine air intake system 112. In the illustrated embodiment, the engine air intake system 112 comprises an air intake chamber 114 positioned on the upper port side of the engine 12, which passes air C from the engine compartment 44 to the carburetors 110.

In the illustrated embodiment, the air intake chamber 114 includes at least one inlet 116 which is open to the engine compartment 44. As shown in FIG. 3, the inlet 116 extends above the engine 12 and is turned downwardly, thus reducing the likelihood that water may splash into the inlet 116. The inlet 116 allows air C from the engine compartment 44 to flow into an interior 118 of the air intake chamber 114. The air intake chamber 114 also preferably includes one outlet 120 for each carburetor 110 included on the engine 12. In the illustrated embodiment, the engine includes four carburetors 110 thus, the air intake chamber 114 includes four outlets 120 aligned with the carburetors 110.

In the illustrated embodiment, the air intake chamber 114 guides air C into the carburetors 110. The carburetors 110 mix the air C flowing through the outlets 120 with fuel supplied by the fuel system and delivers the fuel air charge to a plurality of combustion chambers, discussed below, formed in the engine 12. Of course, other arrangements, such as direct or indirect fuel injection, could be used to provide a fuel charged to the engine 12.

Figure 7:
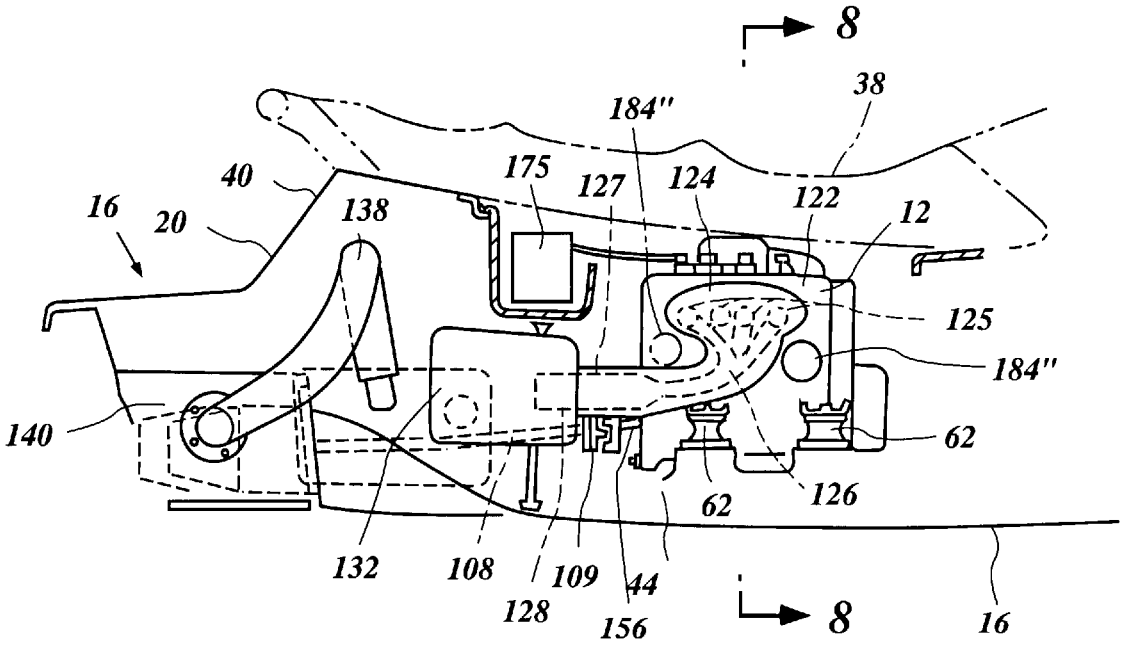
FIG. 7 is a partial sectional side elevational view of a further modification of the watercraft shown in FIG. 1.

With reference to FIGS. 1 and 3, the engine 12 preferably includes an engine exhaust system 122 which guides exhaust gases exiting the engine to the atmosphere. The engine exhaust system 122 includes an exhaust manifold 124 which communicates with each of the combustion chambers formed within the engine 12. The exhaust manifold 124 includes at least one passage 125 (FIG. 7) communicating with each combustion chamber formed within the engine 12, then merges each individual passage 125 into a common passage 126 or pipe which connects to various other exhaust components. Optionally, the exhaust system 122 may include a divergent section 127 downstream from the common passage 126, in which the common passage 126 is divided into a number of individual passages 128, as shown in FIGS. 3 and 7.

By including the divergent section 127 downstream from the common passage 126, the exhaust system 122 provides additional sound attenuation of the exhaust of the engine 12. The resulting sound attenuation is due to the characteristics of the flow of exhaust gases into the common passage 126 and subsequently into the divergent section 127. For example, by merging the individual passages 125 into the common passage 126, the exhaust gas flow is compressed. However, by dividing the exhaust flow into individual flows at the divergent section 127, the exhaust flow is expanded, thus generating sound attenuation of the exhaust flow. Additionally, the surface area of the individual exhaust passages 128 is greater than that of the common passage 126, thus allowing a higher heat transfer rate into a fluid flowing through a cooling jacket provided around the passages 128, discussed in more detail below.

With reference to FIG. 1, the exhaust manifold 124 is connected to a first exhaust pipe 130 which extends rearwardly from the exhaust manifold 124 to a exhaust expansion chamber 132.

The expansion chamber 132 opens into an enlarged chamber which is configured to attenuate the noise carried by the flow of exhaust gases, in a known manner. The expansion chamber 132 communicates with a water lock 134 via a second exhaust passage 136, as shown in FIG. 1.

The water lock 134 is a well known device that allows exhaust gases to pass therethrough, but contains a number of baffles (not shown) which prevent water from passing back through the exhaust passages 136, 130 and the expansion chamber 132 and into the engine 12. In the preferred embodiment, the water trap 134 is located on one side of the hull tunnel 88.

The water trap transfers exhaust gases to a third exhaust pipe 138. The exhaust pipe 138 passes over the hull tunnel 88 to a discharge 140 formed on the starboard side of the hull tunnel 88 and discharges the exhaust gases to the pump chamber 106, such that the passage of water through the exhaust pipe 138 into the water trap 134 is further inhibited.

With reference to FIG. 3, the construction of the engine 12 will now be described in more detail. As shown in FIGS.

1–3, the engine 12 is of an inline type and operates under a four-stroke principal. However, it is to be understood that the engine may be of a V-type configuration. The engine 12 is formed of an engine body 142 having a cylinder head 144, a cylinder block 146 and a crankcase 148.

The cylinder block 146 is formed with four vertically extending cylinder bores 150. The cylinder bores 150 may be formed from thin liners that are either cast or otherwise secured in place within the cylinder block 146. Alternatively, the cylinder bores 150 may be formed directly in the base material of the cylinder block 146. If a light alloy casting is employed for the cylinder block 146, such liners can be used.

In the illustrated embodiment, the cylinder block 146 includes four cylinder bores 150. One piston 152 is provided within each cylinder bore 150. The pistons 152 are supported for reciprocation in the cylinder bores 150, respectively. Piston pins (not shown) connect the pistons 152 to respective connecting rods 154. The connecting rods 154, are journaled on throws of a crankshaft 156. The crankshaft 156 is journaled by a plurality of bearings within the crankcase 148 to rotate about a crankshaft axis which is generally parallel with the longitudinal axis of the watercraft 10.

The cylinder head 144 is provided with individual recesses which cooperate with the respective cylinder bores 150 and the heads of the pistons 152 to form combustion chambers 158. These recesses are surrounded by a lower cylinder head surface that is planar and held in sealing engagement with the cylinder block 146, or with cylinder head gaskets (not shown) interposed therebetween, in a known manner. This planar surface of the cylinder head 144 may partially override the cylinder bores 150 to provide a squish area, if desired. The cylinder head 144 may be affixed to the cylinder block 146 in any suitable manner.

Poppet-type intake valves 160 are slidably supported in the cylinder head 144 in a known manner, and have their head portions engageable with valve seats so as to control the flow of the intake charge into the combustion chambers 158 through intake passages 162 formed in the cylinder head 144. The intake valves 160 are biased toward their closed position by coil compression springs 164. The valves 160 are operated by an intake camshaft 166 which is journaled in the cylinder head 144. The intake camshaft 166 has lobes which operate the valves 160 through thimble tappets.

The intake camshaft is driven by the crankshaft 156 via a camshaft drive mechanism, which is not shown, but is well known in the art. Thus, a further description of the camshaft drive mechanism is not necessary for one of ordinary skill in the art to practice the invention.

As shown in FIG. 3, the cylinder head 144 includes at least one exhaust passage 168 for each combustion chamber 158. The exhaust passages 168 emanate from one or more valve seats formed in the cylinder head 144, and cooperate with the exhaust system 122, for discharging exhaust gases to the atmosphere.

At least one exhaust valve 170 is supported for reciprocation in the cylinder head 144 for each combustion chamber, in a manner similar to the intake valves 160. The exhaust valves 170 are biased toward their closed position by a coiled compression spring 164. The exhaust valves 170 are opened by an overhead mounted exhaust camshaft 172 which is journaled for rotation in the cylinder head 144. The exhaust camshaft 172 has cam lobes that cooperate with thimble tappets for operating the exhaust valves 170 in a known manner. As shown in FIG. 3, the rotational axis of the intake camshaft 166 and the exhaust camshaft 172 are parallel to each other. Like the intake camshaft 166, the exhaust camshaft 170 is driven in a known manner by the crankshaft 156.

As shown in FIG. 3, a valve cover 174 covers the camshafts 166, 172 and is sealably engaged with an upper surface of the cylinder head 144. As such, the valve cover 174 protects the camshafts from foreign material and entraps any lubricants provided to the camshafts 166, 172.

A suitable ignition system is provided for igniting the air and fuel mixture provided to each combustion chamber 150. Spark plugs (not shown) are preferably fired by a suitable ignition system, which preferably includes an electronic control unit (ECU) 175 connected to the engine 12 by one or more electrical cables 177. Preferably, the ECU 175 is mounted to the bulkhead in a recess 173 fixed to the bulkhead 58. A pulser-coil (not shown) which may be incorporated into the ECU 175, generates firing signals for the ignition system. In addition, the ignition system may include a battery for use in providing power to an electric starter and the like.

The watercraft 10 also includes a lubrication system, referred to generally by the reference numeral 180. The lubrication system 180 includes a lubricant reservoir 182, a lubricant filter 184, and a pump mechanism 186 configured to circulate lubricant between the reservoir 182, the filter 184, and at least one lubricant gallery 189 formed in the engine body 142.

As shown in FIG. 2, the lubricant reservoir 182 is in the form of a tank mounted to one side of the engine body 142. The lubricant reservoir 182 includes a lubricant fill tube 185 which extends forward of the air intake chamber 114 and upwardly to a lubricant fill port 187. The lubricant fill port 187 is arranged to be accessible through the access opening 42, thus allowing the lubricant reservoir 182 to be refilled through the access opening 42.

The lubricant reservoir 182 communicates with the lubricant pump mechanism 186 through a lubricant supply line 188 and a lubricant return line 190. In the illustrated embodiment, the pump mechanism 186 is comprised of a supply pump 192 and a return or "scavenge" pump 194.

With reference to FIG. 3, the supply pump 192 communicates with the lubricant gallery 189 formed in the engine body 142. As shown in FIG. 3, the lubricant gallery 189 extends upwardly from the supply pump 192 to an inlet passage 194 of the lubricant filter 184. The lubricant filter 184 also communicates with an lubricant filter outlet port 196. The lubricant filter outlet port 196 communicates with other various lubricant galleries or lines provided in the engine body 142 for lubricating moving parts within the engine body 142. For example, the lubricant filter outlet port 196 may communicate with a crankshaft lubricant supply gallery 198 for directing lubricants into lubricant passages formed within the crankshaft 156. Additionally, the lubricant filter outlet port 196 may communicate with lubricant galleries configured to guide lubricant to cylinder bores 150, the camshafts 156, 172, and the valves 160, 170.

At the lower end of the engine body 142, an lubricant pan 200 is provided beneath the crankcase 148. In the illustrated embodiment, the lubricant pan 200 is formed monolithically with the crankcase 148. However, the lubricant pan 200 may be formed as a separate member bolted to the crankcase 148 with an appropriate seal provided between the lubricant pan 200 and the crankcase 148.

The lubricant pan 200 forms a lubricant collector 202 separated from the crankcase 148 by a divider such as a baffle plate 204. In the illustrated embodiment, the plate 204 is formed of a bottom surface of the crankcase 148. The baffle plate 204 prevents the lubricant in the collector from being whipped or churned by the crankshaft 156.

As shown in FIG. 3, the baffle plate 204 includes at least one aperture 206 which allows the crankcase 148 to communicate with the lubricant collector 202 so as to allow lubricant to drain easily from the crankcase 148 into the collector 202. The collector 202 forms a pool area 208 for allowing lubricant to pool. An inlet screen 210 is provided in the pool area 208 which leads to a supply passage connecting the inlet 210 with the return pump 194.

In operation, the lubrication system 180 circulates lubricant between the lubricant reservoir 182, the filter 184, and at least one lubricant gallery 188 formed in the engine body 142. For example, during operation of the engine 12, the lubricant pumps 192, 194 are driven, electrically via an electric motor or mechanically via an appropriate transmission (not shown) driven by the crankshaft 156. As the supply pump 192 is driven, it draws lubricant from the lubricant reservoir 182 through the lubricant supply line 188. The supply pump 192 pressurizes the lubricant so as to urge lubricant upwards through the engine gallery 189, the lubricant filter inlet port 194, and into the lubricant filter 184.

Lubricant that is urged into the lubricant filter 184 is filtered therein in a known manner. For example, the lubricant may be forced through a filtering element provided within the lubricant filter 184. After the lubricant is filtered through the lubricant filter 184, the lubricant passes through the lubricant filter outlet port 196 which leads to a variety of lubricant galleries within the engine body 142, as noted above.

After the lubricant has passed through the lubricant galleries within the engine body 142, the lubricant falls to the lower portion of the crankcase 148 and thus through the aperture 206. Under the action of gravity, for example, the lubricant then collects in the pool area 208 of the lubricant pan 202. Lubricant that has collected in the pool area 208 is drawn into the inlet 210 and to the return pump 194. The return pump 194 returns lubricant to the lubricant reservoir 182.

As such, the lubricant system 180 operates under the dry-sump lubrication principle, thus circulating lubricant through the engine using a shallow lubricant pan and thus allowing the engine 12 to be mounted close to an inner surface of the lower hull section 18, as compared to engines employing wet sump type lubrication systems.

The engine 12 also preferably includes a cooling system configured to circulate a coolant in thermal contact with at least one portion of the engine body 142 to thereby cool the engine 12. Preferably, a main coolant line (not shown) communicates with an interior of a high pressure area of the impeller housing 98 to thereby bleed pressurized water from the impeller housing 98. The main coolant line may be connected to various components within the watercraft 10, in order to distribute water thereto to be used as a coolant. Preferably, the main coolant line is connected to a coolant jacket (not shown) formed in the engine body 142 with a known construction. For example, the coolant jacket of the engine body 142 preferably is in thermal contact with each of the cylinder bores 150 and the cylinder head 144.

The coolant jacket also preferably extends into the exhaust system 122. For example, the exhaust manifold 124 may include a coolant jacket in thermal communication therewith. A coolant line may extend between coolant jacket formed around the engine body 142 with the coolant jacket formed around the exhaust manifold 124. Downstream from the exhaust manifold 124, the coolant jacket may extend over a portion of the exhaust pipe leading from the exhaust manifold.

As shown in FIG. 3, the exhaust manifold 124 may form a cooling jacket around individual exhaust pipes 128 leading from each combustion chamber 158. Preferably, the coolant flowing through the coolant jacket formed around the exhaust manifold 124, is eventually mixed with the exhaust gases flowing through the exhaust system and discharged to the atmosphere.

With reference to FIG. 3, the cooling system may also include a lubricant cooler 212. The lubricant cooler 212 is mounted between the lubricant filter 184 and the engine body 142. The lubricant filter 184 communicates with the lubricant gallery 189 through the lubricant filter inlet port 194 and the lubricant filter outlet 196 which extends through the lubricant cooler 212. As shown in FIG. 3, the lubricant cooler 212 is connected to a coolant inlet line 214 and a coolant outlet line 216.

In operation, coolant, such as water bled from the high pressure area of the impeller housing 98, is supplied to the lubricant cooler inlet line 214. Coolant flowing into the lubricant cooler 212 from the lubricant inlet line 214 flows through the lubricant cooler 212 and into thermal communication with the lubrication filter inlet 194 and the lubrication filter outlet 196, so as to cool lubricant passing therethrough. The lubricant cooler outlet line 216 may extend to a coolant discharge formed on the hull 16 of the watercraft 10, a bilge pump system, or any other known device for discharging coolant from the watercraft.

Additionally, the coolant system may also include a coolant jacket formed around the lubricant reservoir 182, and/or the ECU 175, as well as any other component which may become overheated during operation of the watercraft 10.

As shown in FIG. 2, the lubricant filter 184 is mounted to the same side of the engine 12 as the lubricant reservoir 182. In the illustrated embodiment, the lubricant filter 184 is mounted behind the lubricant reservoir 182.

Figure 4:
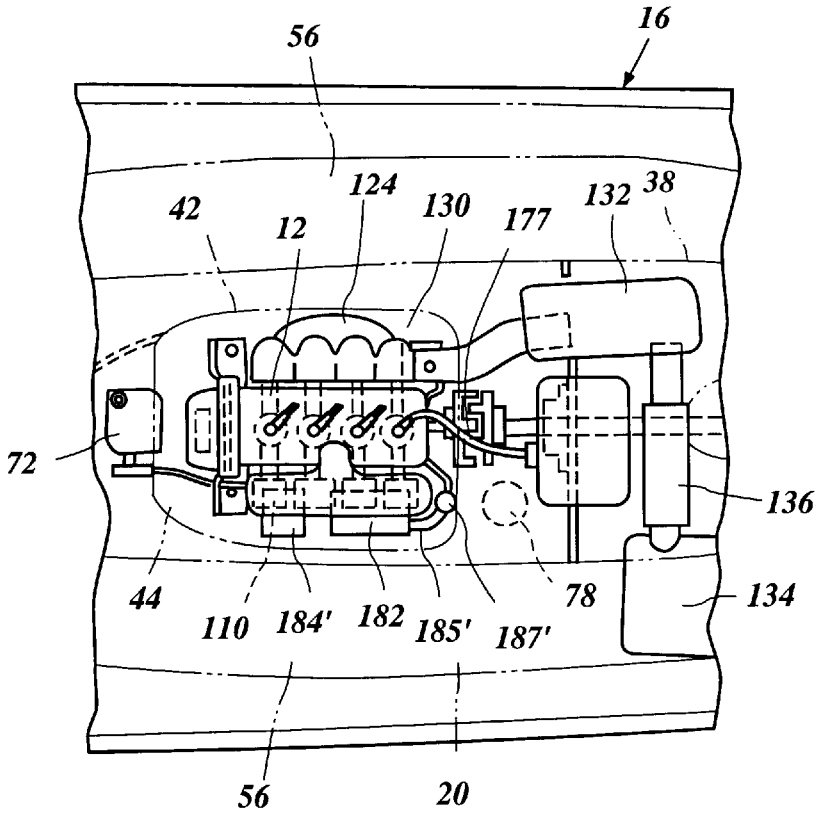
FIG. 4 is a partial top plan view of a modification of the watercraft shown in FIG. 1, with certain internal components of an engine shown in phantom.
Figure 5:
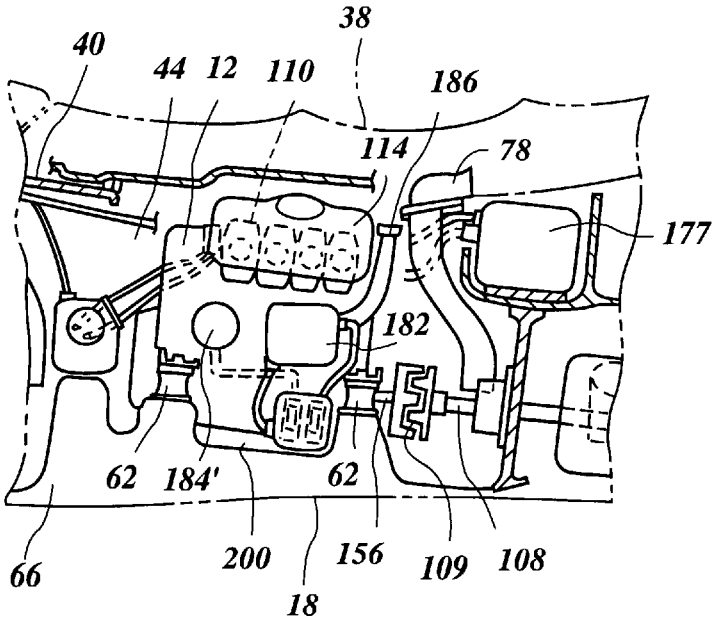
FIG. 5 is a partial sectional side elevational view of the modification shown in FIG. 4.

With reference to FIGS. 4 and 5, a modification of the lubrication system of FIGS. 1–3 is shown therein. As shown in FIGS. 4 and 5, the lubricant filter 184 is mounted on a forward side of the lubricant reservoir 182. In this modification, the lubricant filler tube 185 extends rearwardly from the lubricant reservoir 182 and upward to the lubricant filler port 187. As shown in FIG. 4, the filler port 186 is arranged so as to be accessible through the access opening 42.

By positioning the lubricant filter 184 on either the front or rear side of the lubricant reservoir 182, the present invention provides a compact arrangement for a lubrication system of a small watercraft. For example, as shown in FIGS. 1–5, with the lubricant filter 184 next to the lubricant reservoir 182, and with both the lubricant filter 184 and the lubricant reservoir 182 being mounted to the same side of the engine 12, the lubrication system components do not excessively increase the overall width of the engine 12. Thus, the engine 12, incorporating the lubrication system 180 as shown in FIGS. 1–5, can be contained within the engine compartment 44 which is formed by the seat pedestal 40. As noted above, since an operator straddles the seat pedestal 40 during operation, the overall width of the seat pedestal 40, and thus the width of the engine compartment 44, directly affect the comfort level of the user sitting on the seat cushion 38. Thus, by arranging the components of the lubrication system 180 such that the overall width of the engine is not excessively increased, the engine 12 can be contained within the engine compartment 44 without adversely affecting the comfort level of a user operating the watercraft 10.

Another advantage stemming from the arrangement of the lubricant filter 184 on either the front or rear side of the lubricant reservoir 182, and on the same side of the engine is that the lubricant galleries and lines connecting these components of the lubrication system are more compactly arranged. For example, internal combustion engines are known to have numerous electrical and fluidic connection lines connecting the various systems connected the engine, such as the electrical system, the ignition system, the fuel supply system, the cooling system, and the exhaust system. Each of these systems have various types of connections including electrical and fluidic lines, which extend between components of the same system as well as components of different systems. As such, internal combustion engines are notorious for having tangled webs of various kinds of connections extending throughout the engine compartment in which the internal combustion engine may be housed.

Thus, by arranging the lubricant filter 184 on the same side of the engine 12 as and on either the front or rear side of the lubricant reservoir 182, the present invention simplifies the layout of the lubrication system and thus makes it more simple to assemble and/or service. For example, during assembly of the lubrication system 14 with the engine 12, the filter 184, the lubricant reservoir 182, and the lubricant lines 188 and 190 must be installed onto or connected to the engine. By arranging the lubricant filter 184 on the same side of the engine 12 as the lubricant reservoir 182 and on either the front or rear side of the lubricant reservoir 182, these components can be connected to the engine by an assembly worker while standing on one side of the engine, thus simplifying the procedure for assembling the lubrication system 14 to the engine 12. Additionally, when the lubricant system is checked for leaks, the connections to the lubricant reservoir 182 and the lubricant filter 184 can be viewed simultaneously, thus simplifying the detection of leaks from these components.

Figure 6:
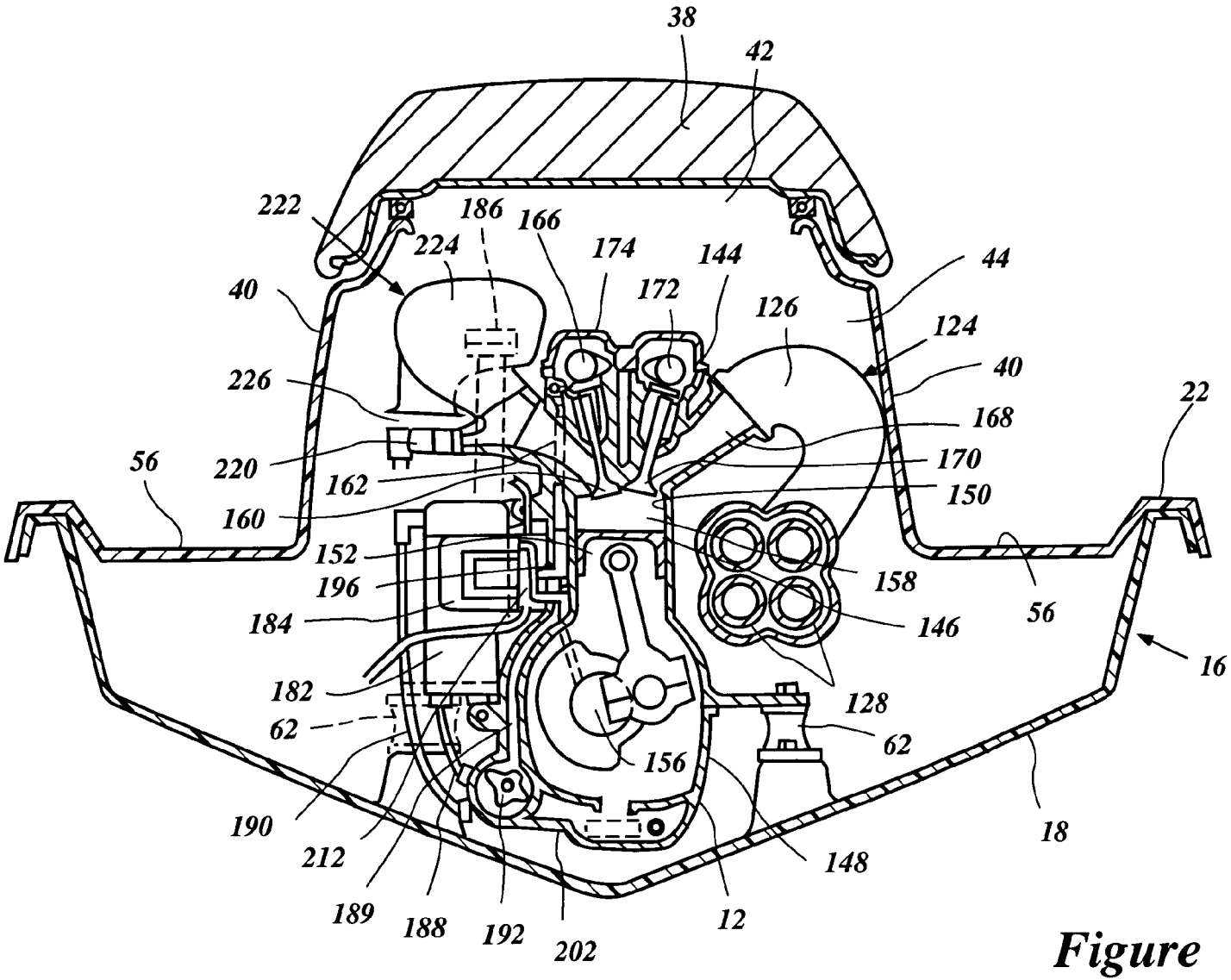
FIG. 6 is a cross-sectional view of a modification of the watercraft shown in FIG. 1.

As shown in FIG. 6, the lubrication system arrangements shown in FIGS. 1–5 can also be used with fuel injected engines and engines with other intake air chambers. For example, as shown in FIG. 6, the engine 12 is provided with at least one fuel injector 220 corresponding to each combustion chamber 158. The fuel injectors 220 are arranged to communicate at least one intake passage 162 for each combustion chamber 158. Thus, the engine 12 shown in FIG. 6 operates under an induction type fuel injection system. However, the engine 12 may alternatively operate under a direct injection principal.

In this embodiment, the watercraft 10 preferably includes a control system appropriate for controlling the firing of the fuel injectors 220 and spark plugs (not shown). For example, the ECU 175 may be used to control the firing of the fuel injectors, as well as the firing of spark plugs which communicate with the combustion chambers 158, in a known manner.

As shown in FIG. 6, the watercraft 10 includes an induction system similar to the induction system 112 shown in FIGS. 1–5. As illustrated in FIG. 6, the engine 12 includes an air intake box 222 forming an air intake chamber 224. As shown in FIG. 6, the air intake box 222 includes an inlet 226 which is turned downwardly over the fuel injectors 220.

One advantage stemming from arranging the inlet 226 as such, is that air flowing into the intake air box 222 through the inlet 226 flows past the fuel injectors 220, thereby cooling the fuel injectors. This is beneficial because the fuel injectors 220 are typically energized by solenoids, which generate heat during operation. Thus, by arranging the inlet 226 so as to cool the fuel injectors 220, the useful life of the fuel injectors 220 may be extended.

Figure 8:
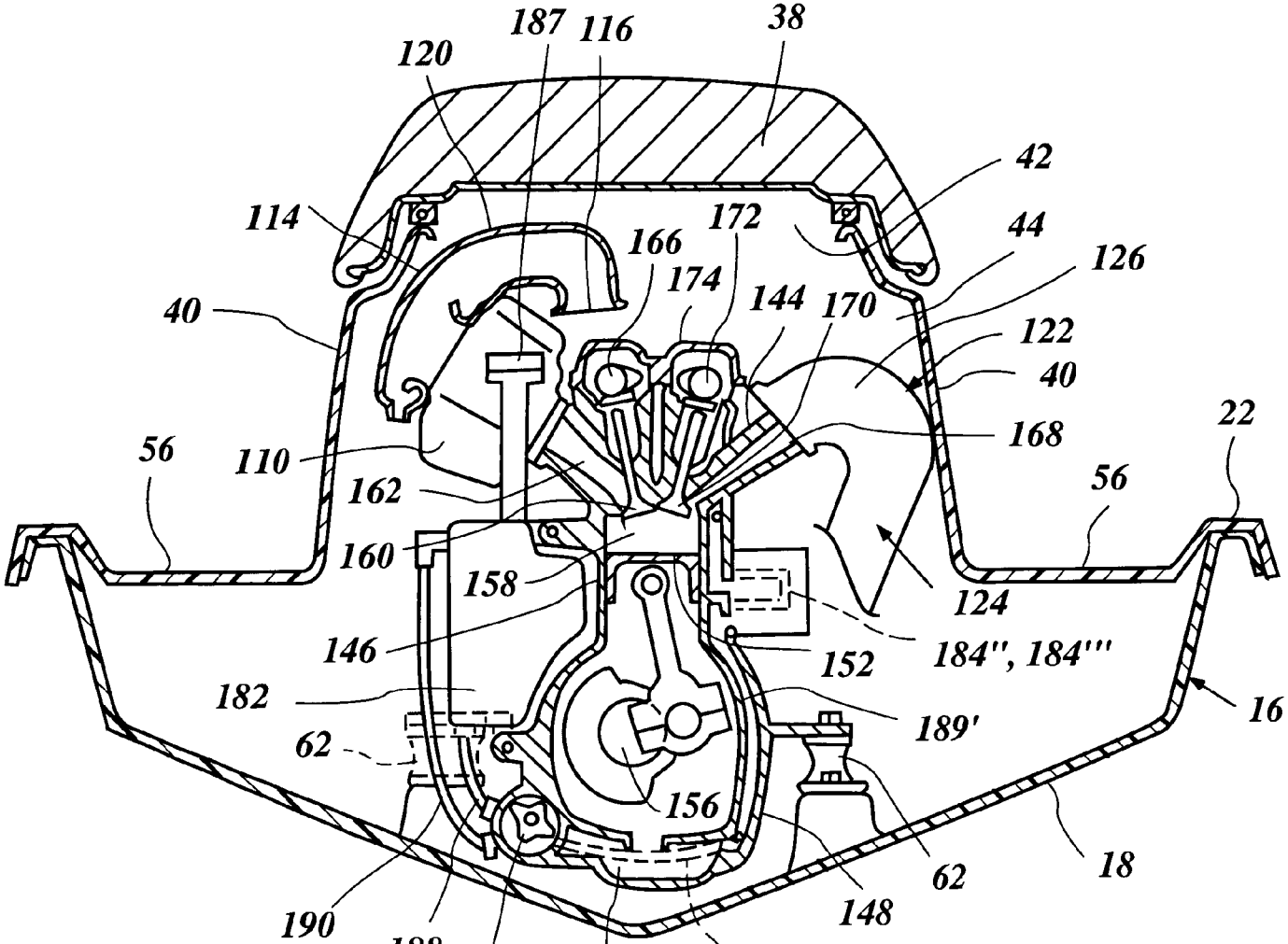
FIG. 8 is a cross-sectional view of the watercraft shown in FIG. 6 taken along line 8—8.

With reference to FIGS. 7 and 8, a further modification of the lubrication system 180 shown in FIGS. 1–5 as shown therein. In the modification illustrated in FIGS. 7 and 8, the lubricant filter 184" is mounted on a forward side of the exhaust manifold 124. Alternatively, the lubricant filter 184 may be mounted rearward from the exhaust manifold 124, in the position labeled as 184'''.

As shown in FIG. 8, with the lubricant filter 184", 184''' mounted to the same side of the engine as the exhaust manifold 124, the lubricant gallery 189' is formed on an opposite side of the engine body 146 from the lubricant reservoir 182. Thus, a lubricant feeder passage 230 is provided which extends from the lubricant supply pump 194 to the lubricant gallery 189' so as to direct pressurized lubricant from the pump 194 up to the lubricant filter 184", 184'''.

With the lubricant filter 184", 184''', arranged on either a forward end or a rearward end of the exhaust manifold 124, the lubrication system 180 of the present invention provides a compact arrangement for the engine 12 within the watercraft 10.

Figure 10:
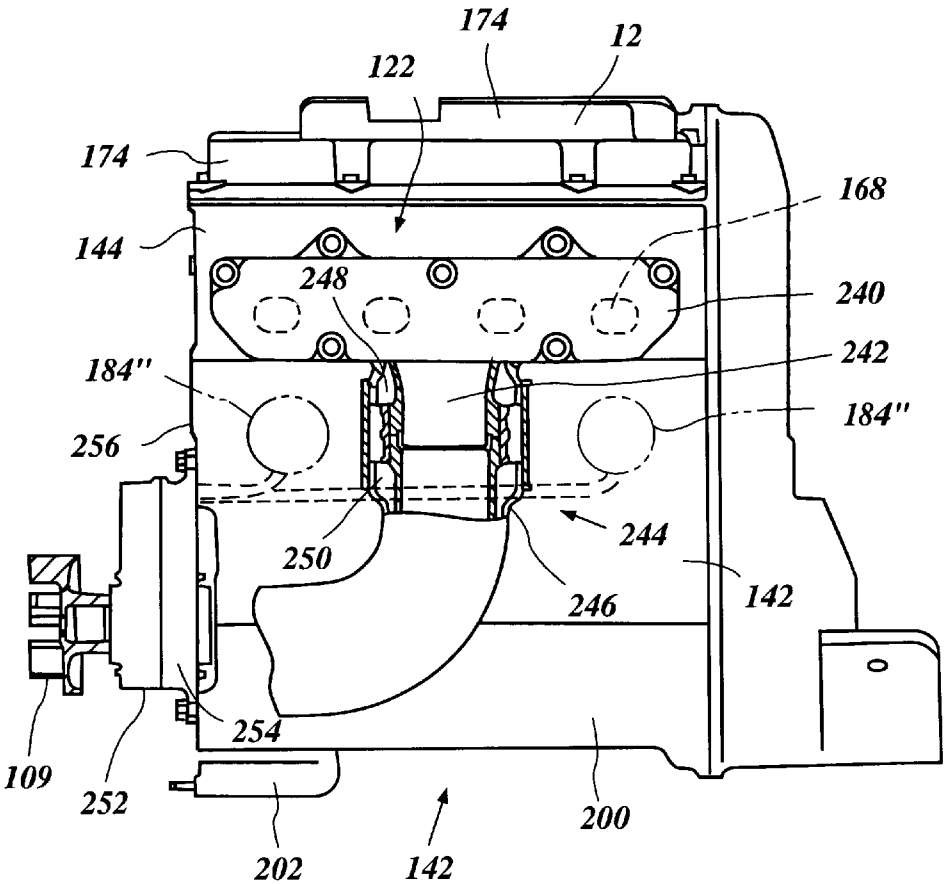
FIG. 10 is a partial sectional and side elevational view of the lubrication system shown in FIG. 9.
Figure 9:
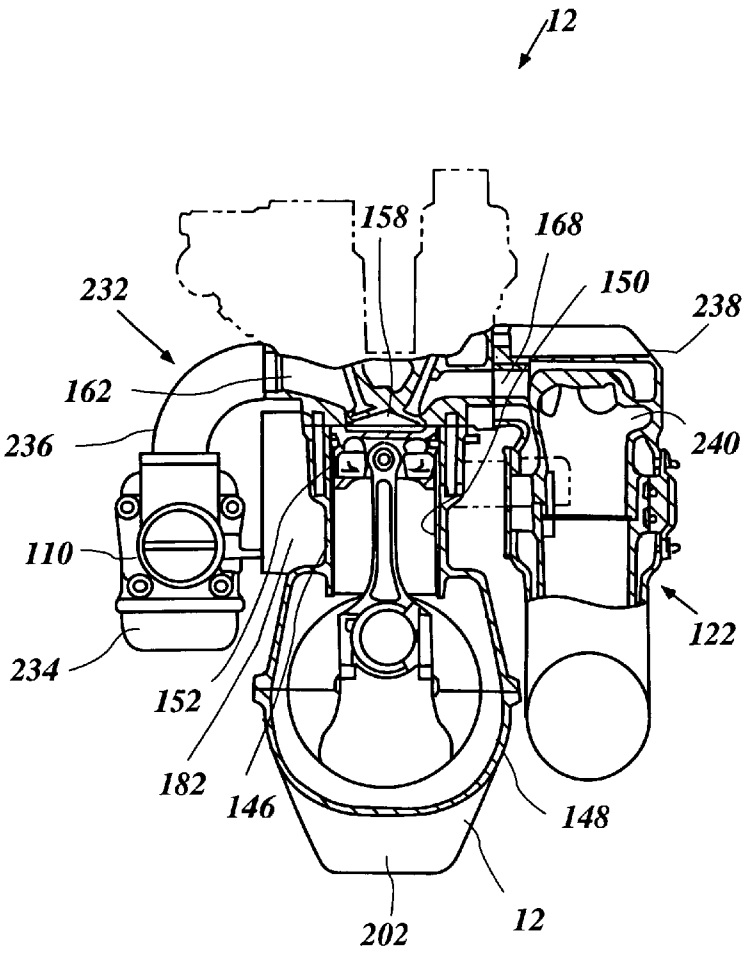
FIG. 9 is a partial sectional and rear view of a modification of the lubrication system shown in FIG. 1.

With reference to FIGS. 9 and 10, a further modification of the engine 12 is shown therein. As shown in FIG. 9, the engine 12 includes an induction system 232 having an air intake box 234 extending next to the crankcase 148. As shown in FIG. 9, at least one carburetor 110 is mounted above the air intake box 234 and communicates with at least one intake runner 236. Although it is possible to form the induction system 232 with one carburetor 110 feeding all of the combustion chambers 158, it is preferable that there is one carburetor for each pair of combustion chambers 158 or one carburetor 110 for each combustion chamber 158. As shown in FIG. 9, the intake runners 236 communicate with the intake passages 162, so as to feed fuel air charges to the combustion chambers 158 for combustion purposes.

As shown in FIGS. 9 and 10, the engine 12 illustrated therein includes an exhaust manifold 238 which guides exhaust gases discharged from each of the exhaust passages 168 into a common chamber 240. As shown in FIG. 10, the exhaust manifold includes a downwardly extending passage 242 communicating with the common chamber 240.

The exhaust system 122 shown in FIG. 10 also illustrates a concentric coupling device 244 which couples the common exhaust passage 242 with an exhaust pipe 246. Additionally, the concentric coupling device 244 connects a cooling jacket 248 formed around the exhaust passage 242 with an annular coolant jacket 250 formed around the exhaust pipe 246.

As shown in FIG. 10, the lubricant filter 184 may be positioned forward of the concentric coupling device 244, illustrated as lubricant filter 184" or rearward from the concentric coupling device 244 in the position labeled as 184'". In this embodiment, a lubricant supply pump 252 and a lubricant return pump 254 may be driven directly by the crankshaft. In this embodiment, the lubricant pumps 252, 254 are mounted between the rearward end 256 of the engine body 142 and the transmission coupling 109. Thus, with the lubricant pumps 252, 254 arranged as such, additional space is provided for mounting the induction system 232 on the same side of the engine body 142 as the lubricant reservoir 182.

Figure 11:
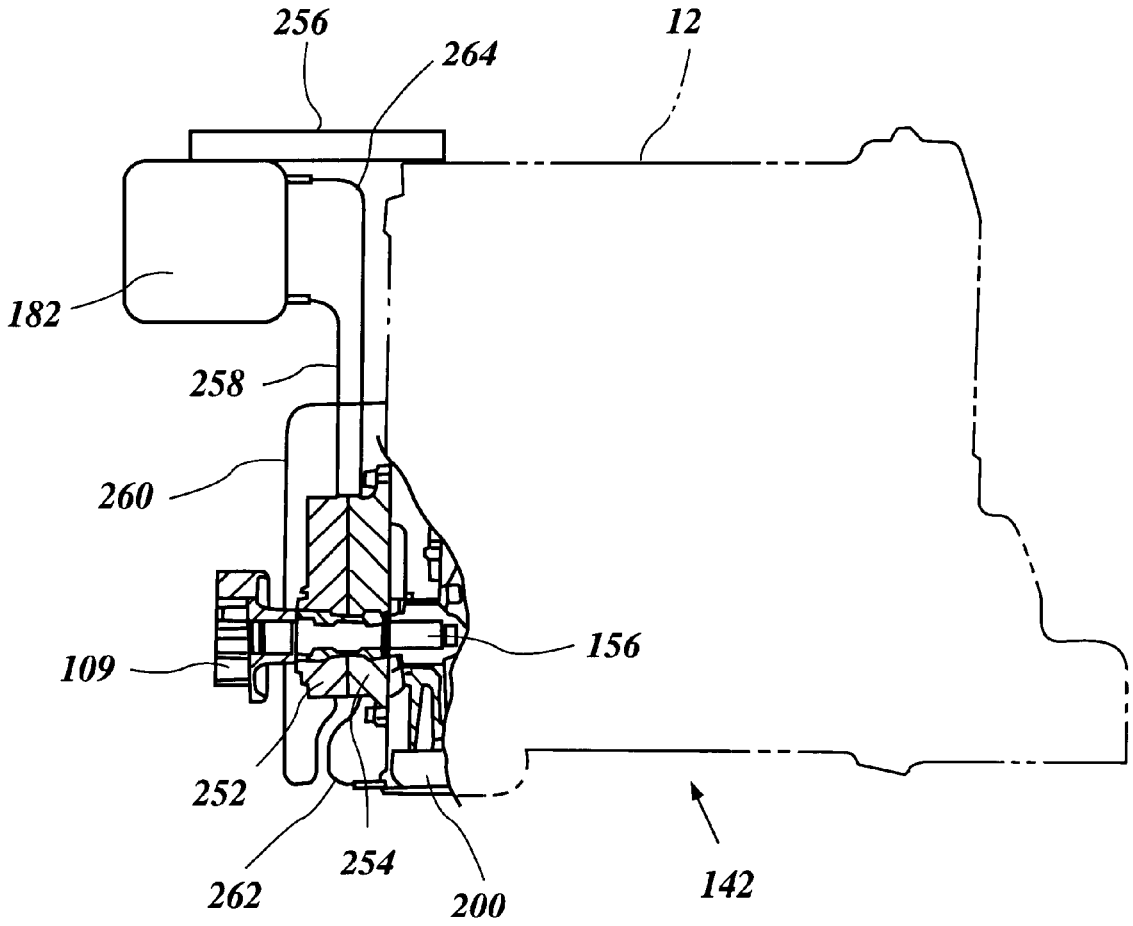
FIG. 11 is a partial sectional side elevational view of a modification of the lubrication system shown in FIG. 9.

With reference to FIG. 11, a further modification of the embodiment of FIG. 10 is illustrated therein. As shown in FIG. 11, with the supply pump 252 and the return pump 254 mounted at the rear of the engine body 142, the lubricant reservoir 182 may also be mounted rearward from the engine body 142. In the illustrated embodiment, a bracket 256 is secured to an upper surface of the engine body 142 with the lubricant reservoir 182 being supported thereby.

In the illustrated embodiment, the supply pump 252 draws lubricant from the lubricant reservoir 182 via a lubricant supply line 258 and urges lubricant through a lubricant engine supply line 260. Lubricant which collects in the lubricant pan 200 is drawn into the return pump 254 via a lubricant return line 262 and is returned to the lubricant reservoir 182 via a lubricant reservoir return line 264.

Arranged as such, the overall width of the engine 12 is further reduced by placing the pumps 252, 254 and the reservoir 182 to the rear of the engine, thus eliminating the affect of the pumps 252, 254 and the reservoir 182 upon the overall width of the engine 12.

Of course, the foregoing description is that of certain features, aspects and advantages of the present invention to which various changes and modifications may be made without departing from the spirit and scope of the present invention. Moreover, a watercraft may not feature all objects and advantages discussed above to use certain features, aspects and advantages of the present invention. Thus, for example, those skilled in the art will recognize that the invention may be embodied or carried out in a manner that achieves or optimizes one advantage or group of advantages as taught herein without necessarily achieving other objects or advantages as may be taught or suggested herein. The present invention, therefore, should only be defined by the appended claims.

What is claimed is:

1. A small watercraft comprising a hull defining an engine compartment, an internal combustion engine supported within the engine compartment, the engine having an engine body and having an output shaft arranged generally parallel to a longitudinal axis of the hull, a propulsion device supported by the hull and driven by the internal combustion engine, a lubrication system including a lubricant reservoir arranged on a first lateral side of the engine body, a lubricant filter arranged on the first lateral side of the engine body, and at least one lubricant pump, the at least one lubricant pump being configured to circulate lubricant between the engine, the lubricant reservoir, and the lubricant filter, the lubricant filter being arranged completely on one of a forward-most side and a rearward-most side of the lubricant reservoir.

2. The small watercraft of claim 1 additionally comprising an oil pan arranged beneath a crankcase of the engine, and a divider positioned between the crankcase and the oil pan.

3. The small watercraft of claim 1 additionally comprising an access opening formed in the hull above the engine compartment.

4. The small watercraft of claim 3 additionally comprising a seat releaseably engageable with the hull such that the seat at least partially covers the access opening when the seat is engaged with the hull.

5. The small watercraft of claim 3 additionally comprising a lubricant fill tube extending upwardly from the lubricant reservoir to a lubricant fill port, the lubricant fill port being positioned beneath the access opening.

6. The small watercraft of claim 5 additionally comprising at least one combustion chamber defined within the engine body and an air intake chamber communicating with the at least one combustion chamber, the lubricant reservoir being positioned beneath the air intake chamber.

7. The small watercraft of claim 1 additionally comprising a liner including mounting surfaces for the engine, the liner being fixed to an inner surface of the hull, the engine being mounted to the liner.

8. The small watercraft of claim 1 additionally comprising a lubricant cooler arranged between the lubricant filter and the engine body.

9. The small watercraft of claim 1 additionally comprising a pair of foot areas extending along opposite sides of the engine compartment.

10. A small watercraft comprising a hull defining an engine compartment, an internal combustion engine supported within the engine compartment, the engine having an engine body and having an output shaft arranged generally parallel to a longitudinal axis of the hull, a propulsion device supported by the hull and driven by the internal combustion engine, a lubrication system including a lubricant reservoir arranged on a first lateral side of the engine body, a lubricant filter arranged on the first lateral side of the engine body, and at least one lubricant pump, the at least one lubricant pump being configured to circulate lubricant between the engine, the lubricant reservoir, and the lubricant filter, the lubricant filter being arranged completely on one of a forward side and a rearward side of the lubricant reservoir, wherein the at least one lubricant pump is arranged on the first side of the engine body.

11. The small watercraft of claim 10, wherein the at least one lubricant pump comprises a supply pump, the lubrication system additionally comprising a scavenge pump.

12. The small watercraft of claim 10, wherein the at least one lubricant pump is arranged at an elevation below the lubricant filter.

13. A small watercraft comprising a hull defining an engine compartment, an internal combustion engine supported within the engine compartment, the engine having an engine body and having an output shaft arranged generally parallel to a longitudinal axis of the hull, a propulsion device supported by the hull and driven by the internal combustion engine, a lubrication system including a lubricant reservoir arranged on a first side of the engine body, a lubricant filter arranged on the first side of the engine body, and at least one lubricant pump, the at least one lubricant pump being configured to circulate lubricant between the engine, the lubricant reservoir, and the lubricant filter, the lubricant filter being arranged on one of a forward side and a rearward side of the lubricant reservoir, an access opening formed in the hull above the engine compartment, a lubricant fill tube extending upwardly from the lubricant reservoir to a lubricant fill port, the lubricant fill port being positioned beneath the access opening, at least one combustion chamber defined within the engine body and an air intake chamber communicating with the at least one combustion chamber, the lubricant reservoir being positioned beneath the air intake chamber, the lubricant filter being arranged on a rear side of the lubricant reservoir, the fill tube extending toward an end of the air intake chamber.

14. The small watercraft of claim 13, wherein the fill tube extends rearwardly of the air intake chamber.

15. A small watercraft comprising a hull defining an engine compartment, an internal combustion engine supported within the engine compartment, the engine having an engine body, a crankshaft arranged generally parallel to a longitudinal axis of the hull, and an exhaust manifold disposed on a first side of the engine and communicating with at least one combustion chamber defined in the engine, a propulsion device driven by the internal combustion engine, a lubrication system including a lubricant reservoir, a lubricant filter, and at least one lubricant pump configured to circulate lubricant between the engine, the lubricant reservoir, and the lubricant filter, the lubricant filter being arranged on the first side of the engine body and on one of a forward side and a rearward side of the exhaust manifold.

16. The small watercraft of claim 15, wherein the lubricant reservoir is arranged on a second side of the engine body, opposite the first side.

17. The small watercraft of claim 15 additionally comprising an oil pan arranged beneath a crankcase of the engine, and a divider positioned between the crankcase and the oil pan.

18. The small watercraft of claim 15 additionally comprising an access opening formed in the hull above the engine compartment.

19. The small watercraft of claim 18 additionally comprising a seat releaseably engageable with the hull such that the seat at least partially covers the access opening when the seat is engaged with the hull.

20. The small watercraft of claim 18 additionally comprising a lubricant fill tube extending upwardly from the lubricant reservoir to a lubricant fill port, the lubricant fill port being positioned beneath the access opening.

21. The small watercraft of claim 20 additionally comprising at least one combustion chamber defined within the engine body and an air intake chamber communicating with the at least one combustion chamber, the lubricant reservoir being positioned beneath the air intake chamber.

22. The small watercraft of claim 15 additionally comprising a liner including mounting surfaces for the engine, the liner being fixed to an inner surface of the hull, the engine being mounted to the liner.

23. The small watercraft of claim 15 additionally comprising a lubricant cooler arranged between the lubricant filter and the engine body.

24. The small watercraft of claim 15 additionally comprising a pair of foot areas extending along opposite sides of the engine compartment.

25. A small watercraft comprising a hull defining an engine compartment, an internal combustion engine supported within the engine compartment, the engine having an engine body, a crankshaft arranged generally parallel to a longitudinal axis of the hull, and an exhaust manifold disposed on a first side of the engine and communicating with at least one combustion chamber defined in the engine, a propulsion device driven by the internal combustion engine, a lubrication system including a lubricant reservoir, a lubricant filter, and at least one lubricant pump configured to circulate lubricant between the engine, the lubricant reservoir, and the lubricant filter, the lubricant filter being arranged on the first side of the engine body and on one of a forward side and a rearward side of the exhaust manifold, wherein the at least one lubricant pump is arranged on a second side of the engine body, opposite the first side.

26. The small watercraft of claim 25, wherein the at least one lubricant pump comprises a supply pump, the lubrication system additionally comprising a scavenge pump.

27. The small watercraft of claim 26 additionally comprising at least one engine oil gallery extending between the supply pump and the lubricant filter.

* * * * *